US009998814B2

(12) United States Patent
Tirard et al.

(10) Patent No.: US 9,998,814 B2
(45) Date of Patent: Jun. 12, 2018

(54) ACOUSTIC SENSOR WIND CAP AND A CORRESPONDING ACOUSTIC SENSOR

(71) Applicant: SAFRAN ELECTRONICS & DEFENSE, Boulogne-Billancourt (FR)

(72) Inventors: Franck Tirard, Boulogne-Billancourt (FR); Serge Laudo, Boulogne-Billancourt (FR)

(73) Assignee: SAFRAN ELECTRONICS & DEFENSE, Boulogne-Billancourt (FR)

( * ) Notice: Subject to any disclaimer, the term of this patent is extended or adjusted under 35 U.S.C. 154(b) by 0 days. days.

(21) Appl. No.: 15/121,597

(22) PCT Filed: Feb. 26, 2015

(86) PCT No.: PCT/EP2015/054003

§ 371 (c)(1),
(2) Date: Aug. 25, 2016

(87) PCT Pub. No.: WO2015/128410

PCT Pub. Date: Sep. 3, 2015

(65) Prior Publication Data

US 2016/0373846 A1 Dec. 22, 2016

(30) Foreign Application Priority Data

Feb. 27, 2014 (FR) ..... 14 51603

(51) Int. Cl.
*H04R 1/08* (2006.01)
*H04R 1/10* (2006.01)

(52) U.S. Cl.
CPC ..... *H04R 1/086* (2013.01); *H04R 1/1083* (2013.01); *H04R 2410/07* (2013.01)

(58) Field of Classification Search
CPC ..... H04R 1/023; H04R 1/08; H04R 1/083; H04R 1/086; H04R 1/1083; H04R 2410/07
See application file for complete search history.

(56) References Cited

U.S. PATENT DOCUMENTS

2007/0003081 A1* 1/2007 Ram ..... H04R 1/086 381/191
2010/0128901 A1* 5/2010 Herman ..... H04R 1/086 381/98
2010/0270102 A1* 10/2010 Banter ..... H04R 1/023 181/198

FOREIGN PATENT DOCUMENTS

EP 1 241 660 A2 9/2002
FR 1 527 599 A 5/1968
JP 2006 060479 A 3/2006

OTHER PUBLICATIONS

Search Report in French Application No. 1451603 dated Oct. 24, 2014, with English translation coversheet. 3 pages.

(Continued)

*Primary Examiner* — Joshua Kaufman
(74) *Attorney, Agent, or Firm* — Womble Bond Dickinson (US) LLP

(57) ABSTRACT

The present invention relates to a sound capturing system (10) comprising at least one acoustic sensor (2) and a wind cap (1) surrounding the acoustic sensor (2), the wind cap (1) comprises a layer of foam having sound insulating properties covered on its exterior surface with a film that is impervious to water and environmental particles.

5 Claims, 2 Drawing Sheets

(56) References Cited

OTHER PUBLICATIONS

Search Report in International Application No. PCT/EP2015/054003 dated May 29, 2015, with English translation coversheet. 4 pages.

* cited by examiner

ACOUSTIC SENSOR WIND CAP AND A CORRESPONDING ACOUSTIC SENSOR

FIELD OF THE INVENTION

The present invention relates to the field of sound pick-up systems notably those used in the field of detection.

STATE OF THE ART

The sound pick-up systems comprising one or several acoustic sensors have diverse applications.

In particular, such systems may be used for detecting a sound source in order to characterize it and/or to localize it.

An advantageous application is for example the detection of shooting in order to localize the origin by equipping military vehicles.

These sound pick-up systems include acoustic sensors for example loaded onboard the roof of the vehicle. These acoustic sensors are therefore exposed to winds both of weather origin and aerodynamic origin (caused by the displacement of the vehicle).

In order to filter out the parasitic noises, and in particular related to the wind in order to preserve quality sound pick-up, the use of anti-wind caps in combination with the acoustic sensors is known.

Anti-wind caps in foam are notably known, and in synthetic fur.

However, the anti-wind caps in foam filter relatively efficiently the noise generated by the wind but may absorb water in the case of bad weather.

Further, anti-wind caps in synthetic fur protect relatively well from bad weather, but their capability of filtering aerodynamic noise is not sufficient for ensuring sufficient sound pick-up quality for detecting the characteristic sounds of shooting. Further, the anti-wind caps in synthetic fur may collect sand or dust, which is detrimental to the quality of the sound pick-up.

DISCUSSION OF THE INVENTION

The invention gives the possibility of overcoming at least one of the aforementioned drawbacks by proposing a sound pick-up system capable of detecting the characteristic sounds of shooting even in a medium exposed to wind while being robust to bad weather and to dusts.

For this purpose, the invention proposes a sound pick-up system including at least one acoustic sensor, and an anti-wind cap surrounding the acoustic sensor, the anti-wind cap including a foam layer having sound insulation properties covered on its outer surface with a water-proof film and impervious to the environmental particles.

The invention is advantageously completed with the following features, taken individually or in any of their technically possible combinations:

- the sound pick-up system further includes a processing unit notably including an amplifier, said processing unit being configured for compensating sound insulation properties of said anti-wind cap;
- the foam layer is a layer of cross-linked polyurethane foam with open cells;
- the sealing film is a film of polyurethane resin;
- the sealing film is deposited by coating on the foam layer;
- the sealing film is deposited by adhesive bonding, lamination or transfer, at a temperature comprised between 80° C. and 200° C.;

- the sealing film comprises two layers of polyurethane resin deposited in succession;
- the anti-wind cap is hemispherical.

The advantages of the invention are multiple.

The anti-wind cap has the particularity of attenuating acoustic signals in a spectrally uniform way. It is then possible to restore the original acoustic signal by simple amplification.

The anti-wind cap notably efficiently filters the parasitic noises characteristic of aerodynamic effects generated on the acoustic sensor exposed to an air flow while propagating the acoustic waves at the characteristic frequencies of shooting.

The sound pick-up system is then capable of detecting the characteristic sounds of shooting even in a medium exposed to wind while being robust to bad weather and dusts.

The anti-wind cap further has the advantage of being impervious to liquids and particles, which allows the sound pick-up system to be operational even when it is exposed to bad weather or dusts.

DESCRIPTION OF THE FIGURES

Other objects, characteristics and advantages will become apparent from the detailed description which follows with reference to the drawings given as an illustration and not as a limitation wherein.

DETAILED DESCRIPTION OF THE INVENTION

Figure 1:
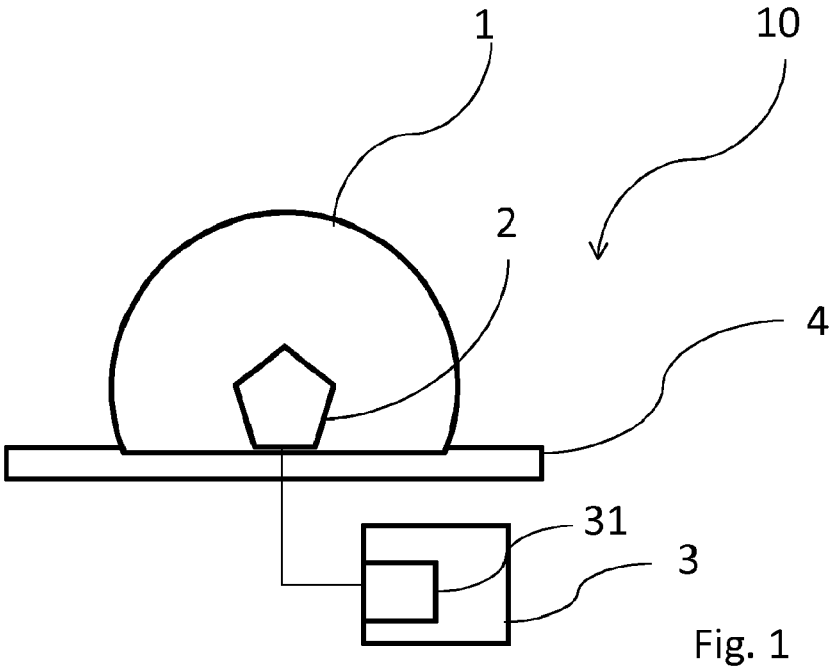
FIGS. 1 and 2 illustrate sound pick-up systems according to the invention.

In FIG. 1, is illustrated a sound pick-up system 10 including an acoustic sensor 2, an anti-wind cap 1, and a processing unit 3. The acoustic sensor 2 transforms the acoustic signals which it receives into electric signals which are transmitted to the processing unit 3, which carries out processing of the signal adapted to a contemplated application (for example characterize or localize a sound source).

The anti-wind cap 1 is advantageously attached on a base 4 so as to form with it a sealing compartment inside which is placed the acoustic sensor 2. The base 4 may for example be the roof of the vehicle on which the sound pick-up system 10 is installed.

Figure 2:
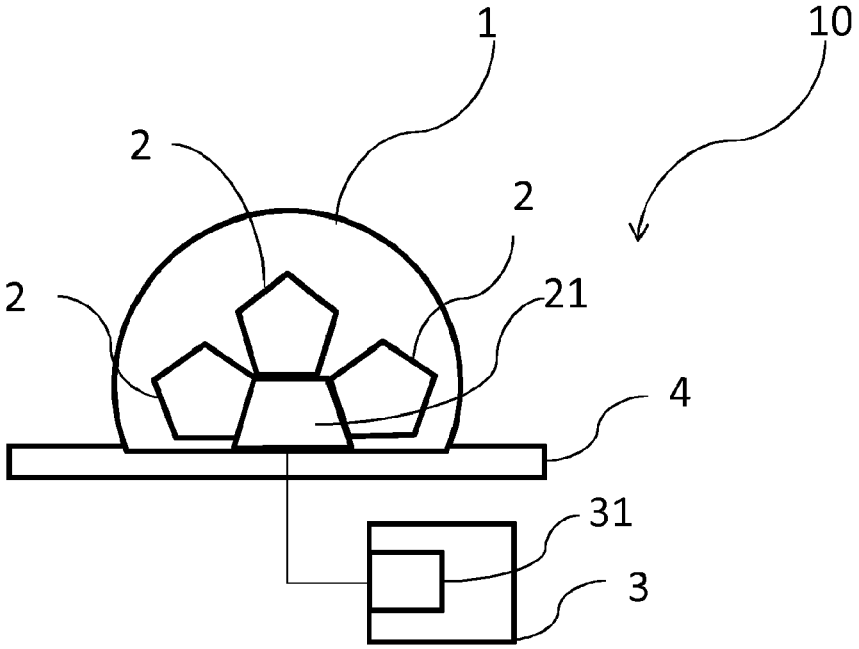

In FIG. 2, a sound pick-up system 10 is illustrated, including several acoustic sensors 2 (three acoustic sensors 2 are illustrated here but of course the sound pick-up system 10 may include a different number thereof) positioned on a support 21 and oriented in different directions. The support 21 and the acoustic sensors 2 are placed inside the sealing compartment defined by the anti-wind cap 1 and the base 4.

The anti-wind cap 1 is preferentially with a general hemispherical shape.

Figure 3:
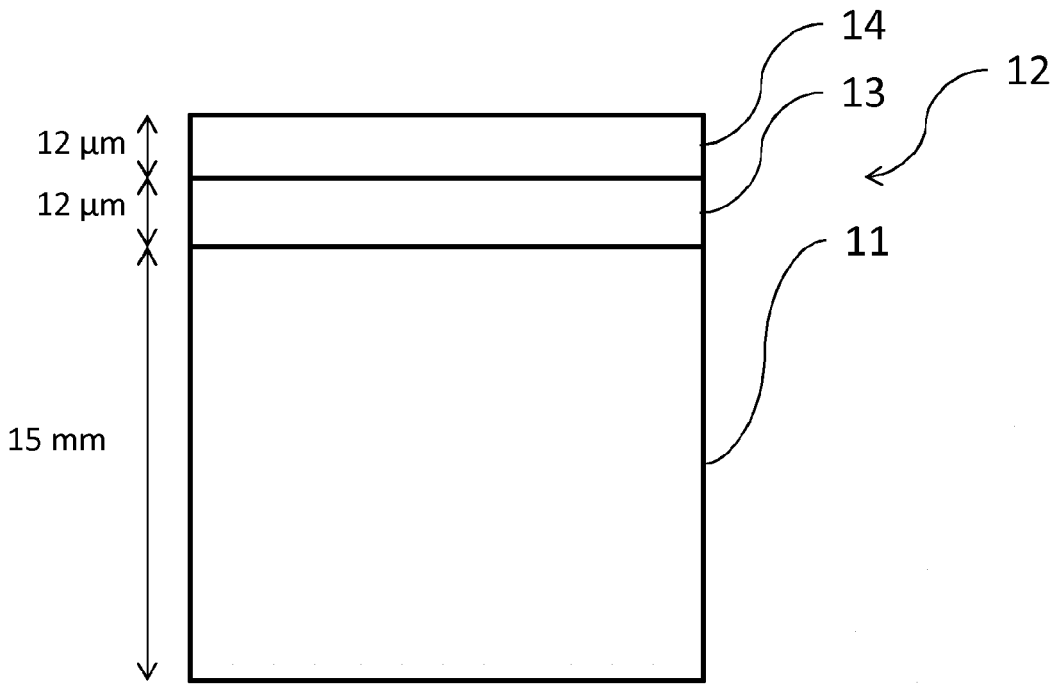
FIG. 3 is a sectional view of the different layers forming an anti-wind cap of a sound pick-up system of FIGS. 1 and 2.

With reference to FIG. 3, the anti-wind cap 1 consists of a foam layer 11 covered on its outer surface with a water-proof film 12 and impervious to environmental particles, and in particular sand and dusts.

The foam layer 11 has sound insulation properties. The foam layer 11 efficiently filters out the parasitic aerodynamic noises in the audible frequency band, due to the flow of the air in front of the acoustic sensor while allowing capture of the sound background.

The anti-wind cap 1 has the particularity of attenuating acoustic signals in a spectrally uniform way. It is then possible to restore the original acoustic signal by simple amplification. This is why the processing unit 3 notably includes an amplifier 31 giving the possibility of compensating for the loss of useful signal introduced by the anti-wind cap 1, in order to obtain a sufficient signal-to-noise ratio for the contemplated application.

The foam layer 11 with open cells allows propagation of the acoustic waves while filtering out the aerodynamic noises. The sealing film 12 let through air and therefore allows optimum propagation of the acoustic waves while blocking the liquids and small particles.

The foam layer 11 preferentially has a thickness comprised between 10 and 25 mm. The foam layer 11 is preferentially a cross-linked foam layer with open cells and preferentially in polyurethane foam. The clear density of the foam is preferentially comprised between 25 and 35 kg/m$^3$. The compression resistance at 40% of the foam is preferentially comprised between 2.5 and 4.5 kPa. The average diameter of a cell of the foam is preferentially comprised between 500 and 800 microns.

The sealing film 12 is preferentially in polyurethane resin and preferentially has a thickness comprised between 10 μm and 15 μm. The density of the sealing film 12 is preferentially comprised between 1.15 and 1.35 kg/m$^3$.

The foam layer 11 of the anti-wind cap is shaped by thermoforming or by cold stressing. The thermoforming allows optimum adjustment to the shape of the support 21 bearing the acoustic sensors 2. This adjustment avoids possible vibrations of the anti-wind cap 1 which may cause noises in the depression areas.

The sealing film 12 is deposited by coating on the foam layer 11 before, during or after, shaping of the latter. The sealing film 12 is preferentially deposited by hot adhesive bonding at a temperature comprised between 80° C. and 200° C. The sealing film 12 preferentially consists of two superposed layers 13 and 14 of polyurethane resin. Indeed, it was demonstrated that an anti-wind cap had better acoustic characteristics when the sealing film 12 consisted of two layers 13 and 14 of polyurethane resin deposited in succession rather than of a single double thickness layer.

The invention claimed is:

1. A sound pick-up system including a plurality of acoustic sensors positioned on a support, the support being mounted on a base, and an anti-wind cap surrounding the acoustic sensors, wherein the anti-wind-cap is substantially hemispherical, and is attached on the base so as to form a sealing compartment for the acoustic sensors, wherein the anti-wind cap includes a foam layer having sound insulation properties covered on its outer surface with a water-proof film and impervious to environmental particles, the water-proof film being in contact with the ambient space, the water-proof film being a polyurethane resin film comprising two layers of polyurethane resin deposited in succession.

2. The sound pick-up system according to claim 1, further including a processing unit including an amplifier, said processing unit being configured for compensating sound insulation properties of said anti-wind cap.

3. The sound pick-up system according to claim 1, wherein the foam layer is a layer of cross-linked polyurethane foam with open cells.

4. The sound pick-up system according to claim 1, wherein the water-proof film is deposited by coating on the foam layer.

5. The sound pick-up system according to claim 1, wherein the water-proof film is deposited by adhesive bonding, lamination or transfer, at a temperature comprised between 80° C. and 200° C.

* * * * *